United States Patent [19]

Blin

[11] Patent Number: 4,509,410

[45] Date of Patent: Apr. 9, 1985

[54] VARIABLE VOLUME FLUID INDUCTION AND DELIVERY MACHINE

[76] Inventor: Jean H. P. Blin, 6, Square Henry PatéParis. France

[21] Appl. No.: 465,671

[22] Filed: Feb. 10, 1983

[30] Foreign Application Priority Data

Feb. 16, 1982 [FR] France ..... 82 02506

[51] Int. Cl.[3] ..... F01B 17/00

[52] U.S. Cl. ..... 92/89; 417/413

[58] Field of Search ..... 92/89, 90, 91, 92, 48; 417/413, 437

[56] References Cited

U.S. PATENT DOCUMENTS

| | | | |
|---|---|---|---|
| 722,259 | 3/1903 | Sleeper | 92/89 |
| 3,152,340 | 10/1964 | Fry et al. | 92/92 X |
| 3,946,641 | 3/1976 | Hirmann | 92/92 X |

*Primary Examiner*—Richard E. Gluck

*Attorney, Agent, or Firm*—D. Peter Hochberg

[57] ABSTRACT

A fluid induction and delivery machine having a chamber of variable volume defined by at least one fixed curved wall, a movable wall facing the fixed wall, and parallel fixed flat walls connecting the curved wall and the movable wall, the movable wall having a rigid middle portion and flexible end portions and being connected between the fixed flat walls.

18 Claims, 7 Drawing Figures

VARIABLE VOLUME FLUID INDUCTION AND DELIVERY MACHINE

Figure 1:
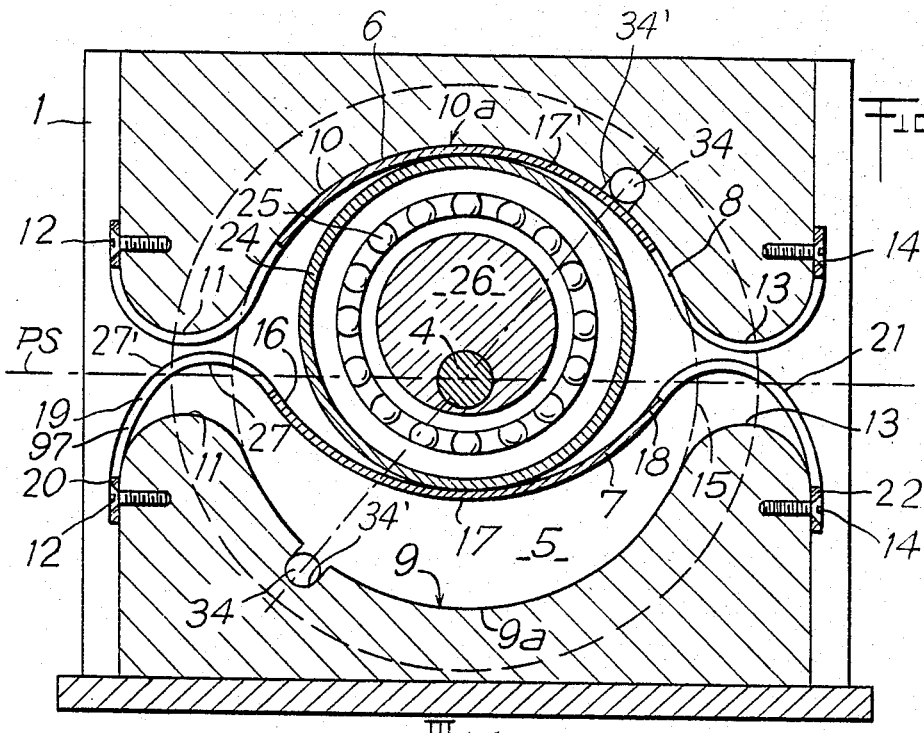

The present invention relates to a fluid induction and delivery machine of the type comprising a chamber of variable volume which is connected via valves, on the one hand, to an induction pipe, and on the other hand to a delivery pipe, and which is defined at least by a fixed curved wall as well as by a wall which is movable with respect to said fixed wall and situated in facing relation thereto, control means being provided for moving said movable wall closer to or away from said fixed wall. This type of machine as known for example from French Pat. Nos. 2 200 908 and 2 236 382 has the disadvantage of being very cumbersome and of low output.

It is the object of the present invention to produce a machine of the aforesaid type but which is of simple design and construction and enables to reach high output rates for a minimum volume.

This object is reached due to the fact that the variable volume chamber is also defined by two fixed flat walls which are parallel to each other and perpendicular both to the first fixed curved wall and to the movable wall, and gripping tightly the transverse edges of the latter, that the longitudinal edges of the movable wall are secured in a tight manner to the corresponding edges of the first fixed curved wall, that the wall comprises a first rigid middle part which extends over its length between the two fixed transverse walls, and has two lateral parts disposed at either side of the rigid middle part and which are flexible in a perpendicular direction to their longitudinal generating lines, the latter being straight and parallel to the fixed edges, and which are rigid in a parallel direction to the straight generating lines.

Owing to this design, the volume of the variable volume chamber can be modified rapidly and successively between a maximum volume and a minimum volume and without there being any really noticeable center volume. Moreover, due to the successive uncovering of the lateral flat walls by the one or more movable walls, the inside of the machine can be efficiently cooled.

By "machine" is meant according to the invention, any apparatus adapted to be used as a gas compressor, gas expander, liquid pump, vacuum-pump, etc.

In order to be able to use valves of large cross-section without creating great lost spaces and which, in addition, ensure adequate tightness, it is advantageous that the suction valve and delivery valve be associated with the fixed cylindrical wall of the variable volume chamber and are disposed one behind the other, each one facing one of two openings provided in the top or bottom parts of said chamber, that said valves each comprise a cylindrical valve-seat and a cylindrical hollow rotary valve, one open end of which communicates permanently with the induction pipe or the delivery pipe and of which a side opening provided in the cylindrical wall of the said valve is adapted to pass before the said valve seat which permanently communicates with the said opening, and that the rotation of the two cylindrical valves are synchronized with the induction stroke and with the delivery stroke of the movable wall, so that the induction valve is open throughout the induction stroke and up to the end thereof and that the delivery valve is open during the second half of the delivery stroke and up to the end thereof.

Owing to this particular construction, it is possible to make very large passageways and therefore to obtain considerable fluid flows whilst limiting to a maximum the leaks between the movable elements and the fixed elements.

The invention will be more readily understood in reading the following description with reference to the accompanying drawings, in which:

FIG. 1 is an elevational view of a cross-section taken perpendicular to the axis of the driving shaft of a first type of machine.

Figure 2:
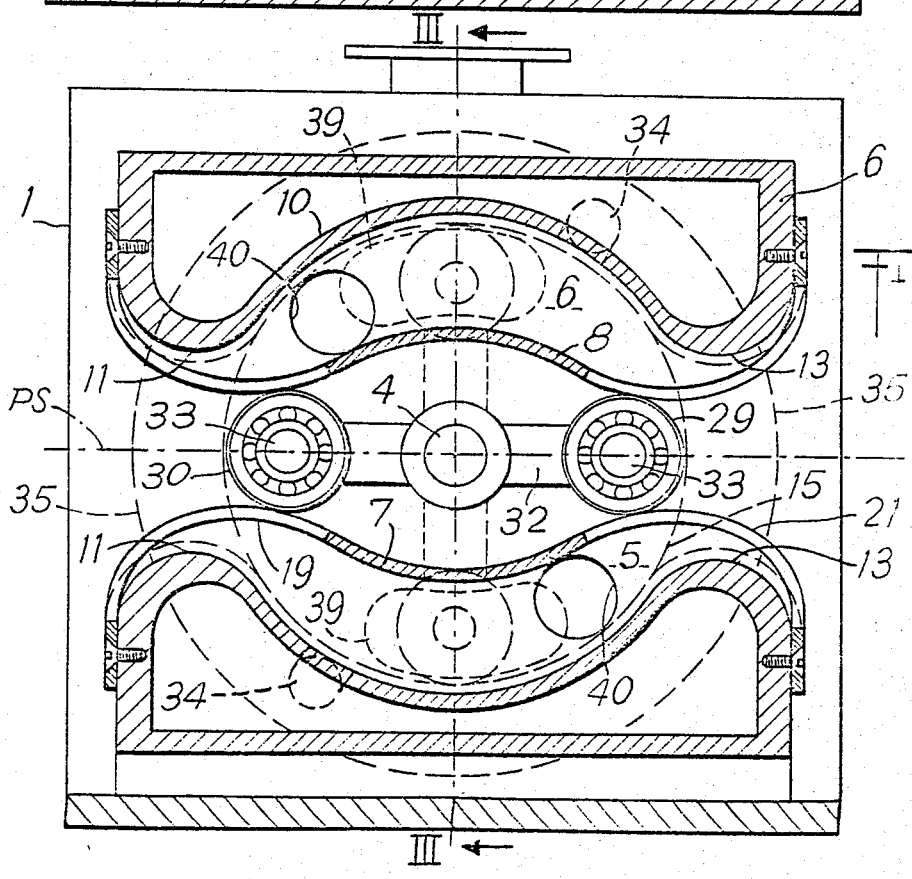
Figure 4:
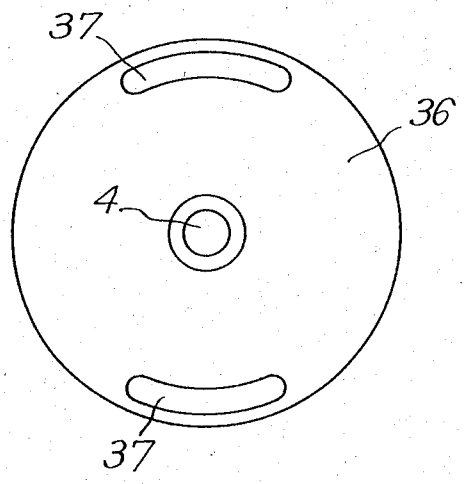
Figure 3:
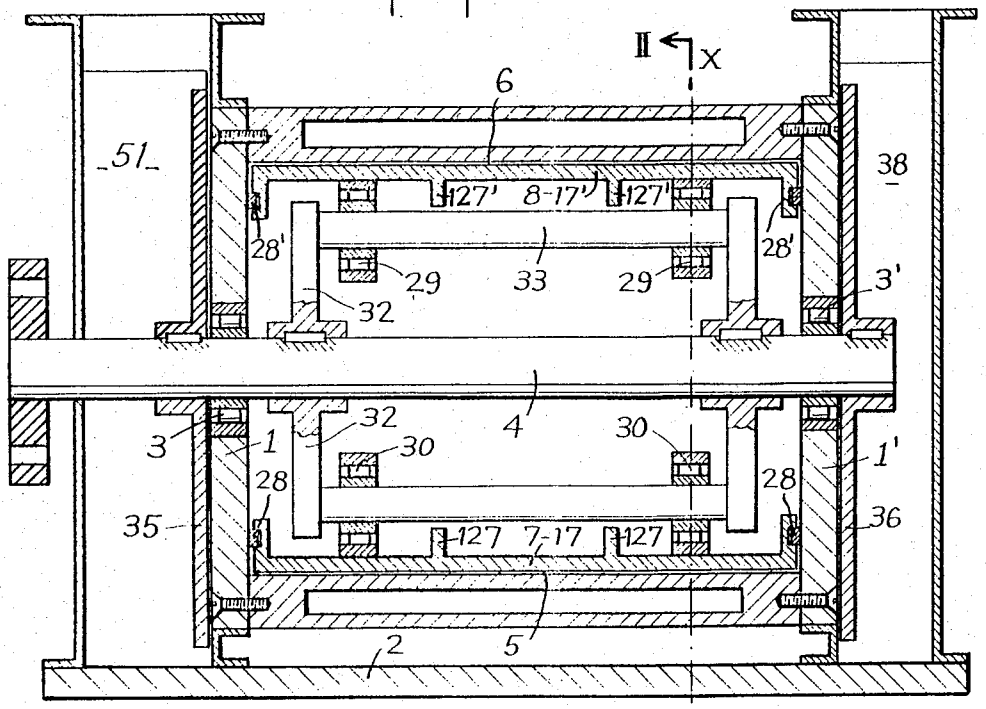
Figure 5:
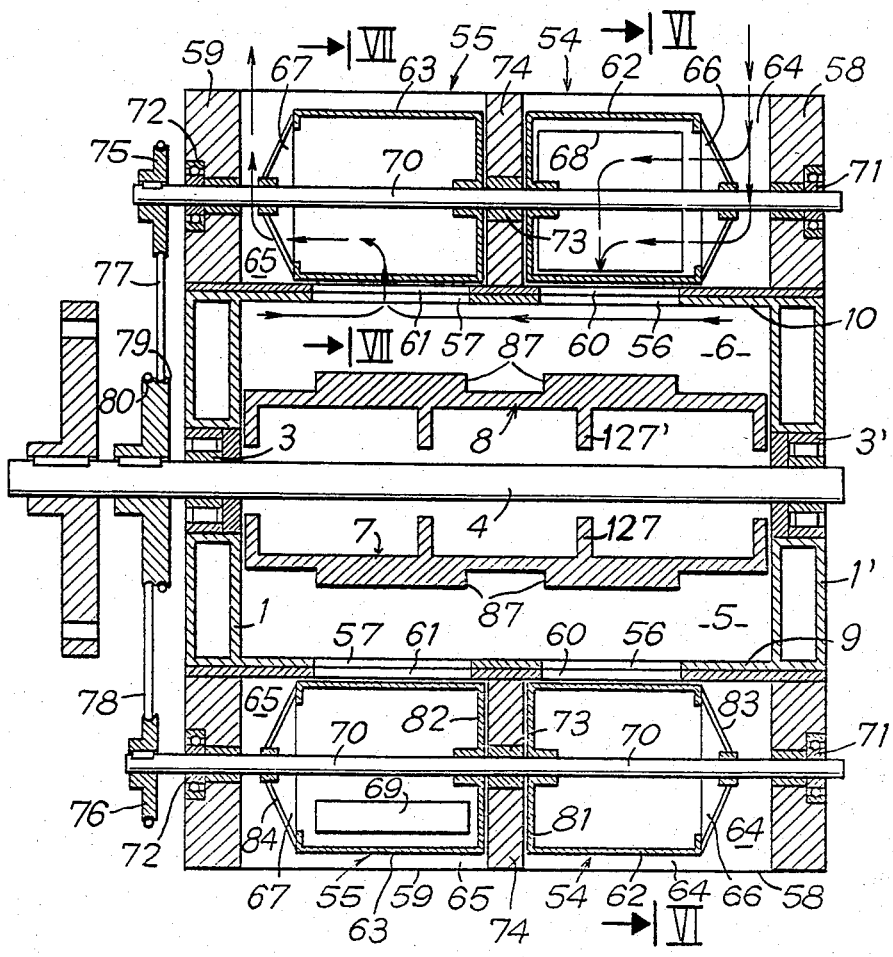
Figure 6:
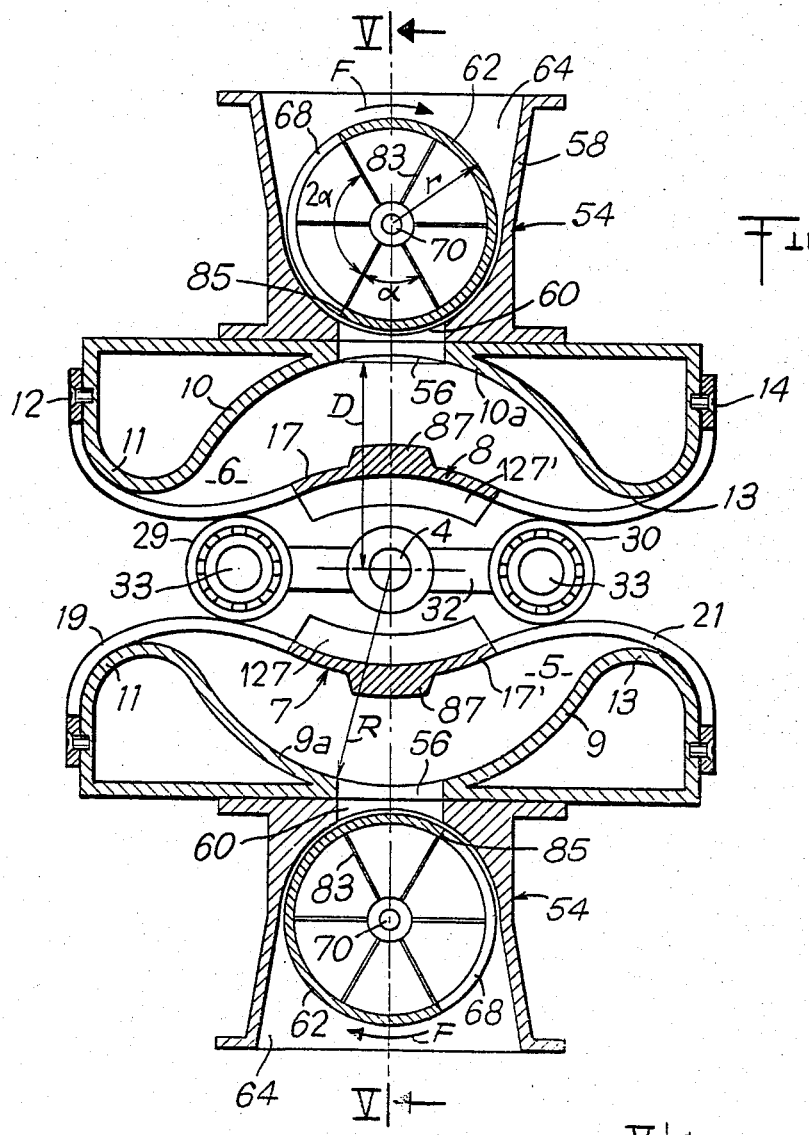
Figure 7:
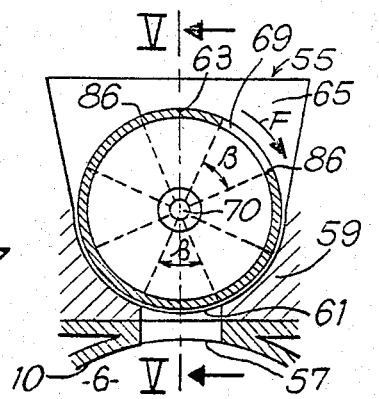

FIG. 2 is an elevational view of a cross-section taken perpendicularly to the axis of the driving shaft of a second type of machine, along line II—II of FIG. 3, FIG. 3 is an elevational view of a longitudinal section traversing the axis of the second type of machine, along line III—III of FIG. 2, FIG. 4 shows on a smaller scale, than the other views, the exhaust distributor disc corresponding to the first two types of machines, FIG. 5 is a front view of a vertical longitudinal section of another embodiment of the machine, taken along line V—V of FIGS. 6 and 7, FIG. 6 is a side view of a vertical cross-section of the machine, taken along line VI—VI of FIG. 5, and FIG. 7 is a side view of a partial vertical section taken along line VII—VII of FIG. 5.

As illustrated very clearly in FIG. 3, each machine comprises two parallel flat side walls or fixed bearing-plates mounted on a base-plate 2. Roller bearings 3, 3' supporting a driving shaft 4, are fitted in bearing-plates 1,1'. Bearing plates 1,1' extend in a transverse direction, and shaft 4 extends in a longitudinal direction.

According to the first embodiment illustrated in FIG. 1, the machine comprises two series of identical elements, i.e. the variable volume chambers 5 and 6 with their longitudinally extending movable walls 7 and 8, arranged symmetrically with respect to a plane of symmetry PS traversing the axis of the shaft 4; said chambers 5 and 6 being situated at equal distance of said shaft.

Each chamber 5, 6 is defined by a first longitudinally extending fixed wall 9 or 10 which, seen from the inside of chamber 5 or 6, has a cylindrical concave part 9*a* or 10*a* which geometrically belongs to the revolving cylinder, whose generating line is the circle 15, and whose axis coincides with that of the shaft 4, and two symmetrical adjacent convex parts 11 and 13, situated outside the said cylinder or circle 15 and connecting up tangentially with the latter.

Each movable wall 7 or 8, secured laterally to the edge of the corresponding fixed wall 9 or 10 by way of screws 12 and 14, comprises a rigid cylindrical middle or central part 17 or 17', which can rest against the concave middle part 9*a* or 10*a* of the fixed curved wall 9 or 10 and two spring-like deformable cylindrical side parts, 19 and 21, adapted to rest against the convex corresponding parts 11, 13 of the rigid wall, the middle part 17 or 17' of the wall 7 or 8, seen from the inside of chamber 5 or 6, being convex and the side parts 19 and 21 being concave. Side parts 19 and 21 are flexible in the transverse direction and rigid in the longitudinal direction.

Runners such as 24, driven by the driving shaft 4 via eccentrics 26 and bearings 25 enable the urging of the movable walls 7, 8 against the fixed curved walls 9 or 10, alternately.

Referring to FIG. 1, and supposing that the driving shaft 4 turns clockwise and that the machine is a compressor, the lower wall 7 will start the compression and the upper wall 8 will be placed in a state of admission, the elasticity of the side parts 19 and 21 of the walls, which side parts are designed as spring plates, continuing to urge the walls 7 and 8 against the runners 24.

It is to be noted that the runners 24, during their displacement, run without friction on the middle part 17, 17' of the walls 7, 8 when pushing them back.

As illustrated in FIG. 1, the elastic and deformable side parts 19, 21 of the walls 7, 8 can be made up of a plurality of spring plates whose cross-section is illustrated in FIG. 1 by the solid lines 27 and 27'; which are in superimposition and separated one from the other by a small space 97 preferably less than the thickness of the middle part 17, 17' of the movable wall 7, 8, which plates can be more than two in number. It is possible with this arrangement to obtain successive expansions of the gas contained in chambers 5, 6 and thus to reduce gas leaks.

FIG. 3, which shows a detailed embodiment of the fixed curved walls 9 and 10 of the chambers 5, 6 and of the walls 7, 8 also applies to the first embodiment. The rigid middle part 17, 17' of the walls 7, 8 is reinforced by arcs 27, 27' perpendicular to the surface of said walls and joints 28, 28' are supported by the edges of said walls and applied against the side plates by way of undulated spring, not shown.

In a second embodiment of the invention illustrated in FIG. 2, the same fixed curved walls 9 and 10 and the same movable walls 7 and 8 are also found, all of which define variable volume chambers 5 and 6, but the control means used for applying said movable wall against said fixed walls are different.

The runners 24 of FIG. 1 are replaced here by two sets of runners 29 and 30 mounted on a longitudinal shaft 33 born by supporting arms 32 keyed on to said shaft 4.

Whereas in the case of the first embodiment (FIG. 1) the induction and compression phases were alternating for each of the two chambers 5 and 6, in this case they are simultaneous. Therefore the flow of fluid delivered per revolution of the shaft is no longer twice the maximum volume of one chamber, but four times that volume. The runners, which have a smaller diameter, turn faster.

The position of the supporting arms 32 which are situated diametrically opposite and turn clockwise, as illustrated in block lines in FIG. 2, corresponds to the end of induction and to the beginning of compression for the two chambers 5 and 6.

The position of the supporting arms 32, of the runners 29 and 30 and of the movable walls 7 and 8, illustrated in dotted lines in FIG. 2 corresponds to the discharge of the compressed fluid and to the beginning of the induction for the two chambers 5 and 6.

This second embodiment permits the obtaining of a perfect balance, with respect to the driving shaft 4, of the forces developed whilst the machine works.

In the two types of machine described hereinabove, the compressed fluid is discharged through the side orifices 34 which communicate with grooves 34' provided in each of the curved fixed walls 9 and 10, said orifices 34 of the bearing-plates 1 and 1' being provided in the area where the lateral convex side parts 11 and 13 of the fixed curved walls 9 or 10 are tangentially joined with the central part 9*a* or 10*a* coinciding with the base cylinder 15 (FIGS. 1 and 2).

There are two such orifices 34 in each bearing-plate 1 and 1', which orifices are diametrically opposite in both types of machine (FIGS. 1 and 2).

Also in both types of machine, the fluid is distributed by way of valves constituted for example by rotary discs placed at each end of the machine next to the corresponding bearing-plate 1, 1'.

Said rotary discs 35 and 36 (FIG. 3) are wedged on to the driving shaft 4, one controlling the induction, the other controlling the delivery of the fluid.

The disc 36 is represented in FIG. 4 as comprising two oblong slots 37 which are shaped in arc of circle and diametrically opposite, said slots allowing delivery into the collector chamber 38 (FIG. 3) when they pass over orifices 34. Tightness between the orifices 34 of the bearing-plates 1, 1' and the rotary disc 35 or 36 is ensured by spring type joints (not shown).

Likewise, the disc 35 (not shown in FIG. 4) comprises two oblong and diametrically opposite slots 39 (of larger dimension than those of the disc 36, indicated in dotted lines in FIG. 2) which enable the induction of the fluid from the induction chamber 51 when said slots. pass over one of the corresponding admission holes 40 provided in bearing-plate 1 inside the circle 15 and level with the chambers 5, 6 in the maximum induction position. Because of the wide passageway allowed between the induction chamber 51 and the variable volume chambers 5, 6, these can fill up very rapidly.

To avoid repetition when describing the embodiment illustrated in FIGS. 6 and 7, the same references have been used to designate the elements also found in the preceding embodiments, whenever these elements have a similar if not identical structure.

For example, the machine illustrated in FIGS. 5 to 7 also has the bearing-plates 1, 1' with the roller bearings 3, 3' supporting the horizontal driving shaft 4, two chambers of variable volume 5, 6 comprising each one a movable wall 7 or 8 actuated from the driving shaft 4 and a fixed wall 9 or 10 of which the central part belongs to a cylinder or circular cross-section the axis of which coincides with that of the shaft 4. For more details, reference can always be made to the precedingly described examples, and in particular to that illustrated in FIGS. 2 and 3.

According to the present embodiment, each chamber of variable volume 5 or 6 is associated to a suction valve 54 and to a delivery valve 55 both of which are placed along the cylindrical top or bottom of said chamber 5 or 6.

To be more specific, the cylindrical and concave middle part 9*a* or 10*a* of the fixed wall 9 or 10, comprises at its top or bottom, two apertures 56, 57 which are preferably aligned one behind the other and extend by their longitudinal edges, parallel to the axis of the driving shaft 4. Each valve 54, 55 is equipped, inside a casing 58, 59 mounted on the machine in facing relation to the top or the bottom of the corresponding chamber of variable volume 5 or 6, with a valve seat 60, 61 of partly cylindrical shape, of which two straight longitudinal edges are parallel to the axis of the shaft 4, and with a rotary hollow cylindrical valve member 62,63 placed inside an induction chamber 64 or a delivery chamber 65 provided in said casing 58, 59. Each rotary hollow valve member 62,63 comprises at least one open end 66,67 through which it is in permanent communication with the induction chamber 64 and its induction pipe or with the delivery chamber 65 and its delivery pipe. Moreover, the rotary valve member 62,63 is also provided with a lateral aperture 68, 69 in its cylindrical wall, and which presents two longitudinal edges parallel to the axis of the cylindrical valve member 62,63. Each one of the lateral apertures 68, 69 is designed to pass for a determined period in front of the valve seat 60 or 61 and the corresponding apertures 56 or 57, so that through a rotation of the valve member 62 or 63, the variable volume chamber 5, 6 is successively connected with induction chamber 64 and its induction pipe, and with delivery chamber 65 and its delivery pipe. Care will obviously have to be taken, in order to reduce losses of load, that the apertures with a constant surface, which are provided to let through the fluid, are at least as large as apertures 56, 57 and as adjacent valve seats 60, 61.

It is advantageous to align the valve members 62 and 63 associated to the same chamber of variable volume 5 or 6 on the same axis parallel to the driving shaft 4 and to correspondingly place the other elements of the suction valve 54 and delivery valve 55, such as the casings 58, 59 and valve seats 60, 61. To this effect, the two rotary valve members 62,63 have the same diameter and are mounted on the same control shaft 70, tightly fitted in bearings 71, 72, 73 provided in the side walls and in an intermediate wall 74 of casings 58, 59 of valves 54, 55. Outside casing 59, a chain-pulley or chain-wheel is keyed on the control shaft 70 and cooperates, via an endless belt or chain 77, 78, with a driving chain-pulley or chain-wheel 79, 80 keyed on the driving shaft 4. In general, the transmission ratio between the driving shaft 4 acting on the movable wall such as 7 or 8, of a variable volume chamber such as 5 or 6, and the control shaft 70 of the suction valve 54 and delivery valve 55 corresponding to said chamber 5 or 6, is selected in relation to the number of variable volume chambers controlled by the same driving shaft 4, and so that each chamber of variable volume is connected with the induction chamber 64 throughout the induction stroke of the corresponding movable wall and after that connected with the delivery chamber 65, or else throughout the entire delivery stroke of the said movable wall when the latter moves an incompressible fluid, or else through the end of the delivery stroke when the delivered fluid is compressible. In the case of the example illustrated in FIGS. 5 to 7, which show a machine with two chambers of variable volume 5, 6, the transmission ratio is equal to 2, so that for half a revolution of the driving shaft 4, the control shaft 70 of the suction valve 54 and delivery valve 55 makes a full revolution.

According to the embodiment illustrated in the drawing, the length of the two valve members 62 and 63 is selected so that the casings 58, 59 housing them do not extend beyond the lateral bearing-plates 1, 1' of the machine and that a wide enough passage, at least equal to the apertures 56, 57 of the corresponding chamber of variable volume 5 or 6, is left in front of the open end 66, 67 of each valve member 62,63 inside the induction chamber 64 or the delivery chamber 55. At its end adjacent the intermediate wall 74, the cylindrical wall of the valve member 62, 63 rests on the control shaft 70 via a closed end 81, 82 and at its open end 66, 67, said cylindrical wall rests on the control shaft 70 by way of a plurality of spokes or cross-bars 83, 84. The width of the holes 56, 57 is selected so that, if projected on the periphery of a cylindrical valve member 62,63, it does not go beyond an angle of opening of 60°.

With respect to the control shaft 70, the angle of opening $\alpha$ of the valve seat 60 of the suction valve 54 is equal to 60°. The angle of opening $\beta$ of the valve seat 61 of the delivery valve 55 is also equal to 60° when the fluid to be delivered is incompressible. By contrast, when the fluid to be transported is compressible the angle of opening $\beta$ of the valve set 61 of the delivery valve 55 is smaller than the angle of opening $\alpha$, in the present case, equal to 45°.

When the object is to keep the flow speeds in the area of apertures 56, 57 and of the corresponding valve seats 60, 61, the longitudinal edges of apertures 57 and of the corrresponding valve seat 61 can, if necessary, be longer than the longitudinal edges of aperture 56 and of the corresponding valve seat 60.

In their parts adjacent the variable volume chamber 5, 6, induction chamber 64 and delivery chamber 65 are semi-cylindrical, in order to receive without any noticeable clearance, the corresponding cylindrical valve member 62,63, which valve member projects lengthwise at both ends of the valve seat 60, 61. The side opening 68 provided in the cylindrical wall of the suction valve member 62 corresponds lengthwise, to the exact length of the corresponding valve seat 60 and widthwise to an angle of opening which is twice the angle of opening $\alpha$ of the suction valve seat 60, i.e. 120° in the present case. Considering the fact that the suction stroke of the movable wall 7 or 8 corresponds to half a revolution of the control shaft 70, the sum of the angles of opening of the suction valve seat 60 and of the side opening 68 of the suction valve member 62 is at the most equal to 180°, as this is the case with the present embodiment. This applies also to delivery valve 55 when the fluid to be transported is incompressible. To the contrary, when the fluid is compressible, the side opening 69 has longitudinal edges of a length equal to that of the longitudinal edges of the delivery valve seat 61, but also longer than the longitudinal edges of the suction hole 68 and than the suction valve seat 60 moreover the opening angle of the side opening 69 is equal to that ($\beta$) of the delivery valve seat 61 and the sum of these two angles is less than 180° in the case of the present embodiment, and generally speaking, less than a rotation angle of the control shaft 70 corresponding to the delivery stroke of the movable wall 7 or 8.

In order to synchronize the opening and closing movements of the suction valve 54 and of the delivery valve 55 with the suction and delivery strokes of the movable wall 7 or 8 of the variable volume chamber 5 or 6, the shaft 70 controlling these valves is not only connected by a transmission with a constant ratio, 75, 77 and 79 or 76, 78 and 80 to the shaft 4 driving the movable wall 7 or 8, it is also keyed on the same control shaft 70 so that the longitudinal edges of their side openings 68 and 69 are angularly offset one with respect to the other. In the case of an incompressible fluid, the angular offset between the longitudinal back edge 85 of the suction hole 68 and the longitudinal front edge 86 of the delivery hole 69 - taken in the direction of rotation F of the control shaft 70 - is equal to the opening angle $\alpha$ of the valve seat 60.

To reduce the lost space, it is possible to provide, opposite the arched ribs 17 and 17' of the movable wall 7 or 8, bosses on movable walls 87 which penetrate apertures 56 and 57 and valve seat 60 and 61 without however penetrating induction chamber 64 and delivery chamber 65.

The invention is in no way limited to the description given hereinabove and on the contrary covers any variants which can be brought thereto without departing from its scope.

For example, it would be possible, as with certain constructions of piston compressors, to mount more than one assembly of elements of the aforedescribed type, on the same driving shaft, which assemblies could be angularly shifted to improve balance or to obtain a multi-stage compression.

What is claimed is:

1. A variable volume induction and delivery machine having a longitudinal direction and a transverse direction, said machine comprising:

a fixed curved wall having transverse edges and longitudinal edges, a wall movable with respect to said fixed wall and situated in facing relation thereto and having transverse edges and longitudinal edges, control means for moving said movable wall closer to or away from said fixed wall, two fixed flat, parallel side walls perpendicular both to the fixed wall and to the movable wall, and tightly engaging the transverse edges of said fixed wall and said movable wall, said four walls defining a chamber of variable volume, an induction pipe provided with a suction valve and connected to said variable volume chamber, a delivery pipe provided with a delivery valve and connected to said variable volume chamber, the longitudinal edges of the movable wall being secured in a tight manner to the corresponding longitudinal edges of the fixed wall, and the movable wall comprising a rigid middle part which extends over its length between its transverse edges, and two longitudinally extending side parts disposed on either side of the rigid middle part, and said side parts being flexible in the transverse direction and rigid in the longitudinal direction.

2. Machine as claimed in claim 1, wherein said side parts of the movable wall comprise elastic spring plates deformable to an expanded position wherein said spring plates are away from said fixed wall, except for their longitudinal edges which are secured to the longitudinal edges of the fixed wall.

3. Machine as claimed in claim 2 wherein each of said side parts of the movable wall comprise at least two spring plates in superimposition and at a small distance one from the other.

4. Machine as claimed in claim 1, wherein said fixed curved wall has a curved cross-section which, seen from the inside of the variable volume chamber, comprises a concave middle part with, on either side, a convex part, the longitudinal edges of said movable wall being secured on the outer edges of the corresponding convex part of the fixed curved wall, and wherein the rigid middle part of the movable wall comprises a convex middle part when viewed from the inside of the variable volume chamber and wherein said flexible side parts comprise a concave part on either side of said middle part.

5. Machine as claimed in claim 4, wherein the concave middle part of the fixed curved wall has a cylindrical surface of circular cross-section and the two adjacent convex parts of said fixed curved wall are situated outside the cylinder defining said cylindrical surface and being tangentially joined thereto.

6. Machine as claimed in claim 4, wherein the rigid convex middle part of the movable wall is cylindrical and, in an applied position, adopts the exact cylindrical configuration of the fixed curved wall.

7. Machine as claimed in claim 4, wherein the developed width of the inner face of each flexible side part of the movable wall, which width is that between the fixed edge of the said side part and the area where said side part tangentially joins up with the convex rigid middle part, is equal to the developed width of the corresponding convex side part of the fixed curved wall.

8. Machine as claimed in claim 4, wherein the variable volume chamber comprises a longitudinal groove provided in the fixed curved wall in the area where the concave middle part of the fixed wall joins up with a convex part adjacent thereto and said groove being connected on one side with the induction pipe and on the other side with the delivery pipe.

9. Machine as claimed in claim 4, wherein the rigid middle part of the movable wall cooperates with an eccentric mounted on a driving shaft whose axis coincides with that of the cylinder defined by the concave part of the fixed curved wall.

10. Machine as claimed in claim 1, wherein said machine comprises a driving shaft having an axis and at least two variable volume chambers situated symmetrically with respect to the axis of the driving shaft.

11. Machine as claimed in claim 10, wherein the driving shaft bears an eccentric which cooperates simultaneously with each of the two movable walls of the two variable volume chambers, so that one of said movable walls is in the maximum delivery position when the other wall is in the maximum induction position.

12. Machine as claimed in claim 10, wherein the driving shaft supports on two diametrically opposite supporting arms, two sets of runners which are placed between the two movable walls of the two symmetrically disposed variable volume chambers, so that when the two movable walls are in the maximum induction position, said walls are simultaneously in contact with the two sets of runners whose axes and that of the driving shaft are then situated inside the plane of symmetry between the two variable volume chambers.

13. Machine as claimed in claim 1, wherein the suction and delivery valves are associated with the cylindrical fixed wall of the variable volume chamber, and are each placed facing one of two apertures provided in the top and bottom part of said chamber, wherein said valves each comprises a cylindrical valve seat permanently communicating with the respective apertures and a cylindrical and hollow rotary valve member, said valve members having one open end which permanently communicates with the induction pipe and with the delivery pipe, respectively and said valve members each further having a cylindrical side wall with one side opening adapted to pass before the respective valve seat, and wherein the rotation of the two cylindrical valve members is synchronized with the induction stroke and with the delivery stroke of the movable wall, so that the suction valve is open throughout the induction stroke and that the delivery valve is open either throughout the entire delivery stroke when the fluid to be delivered is incompressible, or throughout only part of said delivery stroke and up to the end thereof, when the fluid to be delivered is compressible.

14. Machine as claimed in claim 13 and further including a pair of valve casings and a control shaft extending through said valve casings, wherein the cylindrical valve member in the suction valve and the cylindrical valve member in the delivery valve have the same diameter and are mounted on said control shaft.

15. Machine as claimed in claim 13, wherein said machine comprises a driving shaft for said movable wall, and the suction and delivery valve members are moved by said driving shaft.

16. Machine as claimed in claim 13, wherein the opening angle of the suction valve seat is identical to the opening angle of the delivery valve seat and at the most equal to 60° whereas the opening angle of the suction aperture is equal to twice the opening angle of the suction valve seat.

17. Machine as claimed in claim 13, wherein the opening angle of the delivery valve seat is equal to the opening angle of the delivery apeture and less than the opening angle of the suction aperture.

18. Machine as claimed in claim 13, wherein the suction aperture is angularly offset with respect to the delivery aperture.

* * * * *